US011079721B2

(12) United States Patent
Lin

(10) Patent No.: US 11,079,721 B2
(45) Date of Patent: Aug. 3, 2021

(54) LIGHT-EMITTING CLOCK

(71) Applicant: TSUEN JER ENTERPRISE CO., LTD., Taipei (TW)

(72) Inventor: Cheng-Wei Lin, Taipei (TW)

(73) Assignee: TSUEN JER ENTERPRISE CO., LTD., Taipei (TW)

( * ) Notice: Subject to any disclaimer, the term of this patent is extended or adjusted under 35 U.S.C. 154(b) by 574 days.

(21) Appl. No.: 16/136,626

(22) Filed: Sep. 20, 2018

(65) Prior Publication Data

US 2020/0033809 A1 Jan. 30, 2020

(30) Foreign Application Priority Data

Jul. 27, 2018 (CN) ..... 201810840068.9

(51) Int. Cl.

| | |
|---|---|
| ***G04B 19/32*** | (2006.01) |
| ***G04B 19/04*** | (2006.01) |
| ***G04B 19/14*** | (2006.01) |
| ***G04B 37/04*** | (2006.01) |
| ***G04C 17/02*** | (2006.01) |

(52) U.S. Cl.

CPC ..... *G04B 19/32* (2013.01); *G04B 19/04* (2013.01); *G04B 19/14* (2013.01); *G04B 37/04* (2013.01); *G04C 17/02* (2013.01)

(58) Field of Classification Search

CPC ..... G04B 19/04; G04B 19/14; G04B 19/30; G04B 19/32; G04B 37/04; G04C 17/02

USPC ..... 368/240

See application file for complete search history.

(56) References Cited

U.S. PATENT DOCUMENTS

| | | | | |
|---|---|---|---|---|
| 3,757,511 A * | 9/1973 | Burgess | G04G 9/04 | 368/83 |
| 6,183,099 B1 * | 2/2001 | Garay | G01D 11/28 | 362/23.15 |
| 2011/0182151 A1 * | 7/2011 | Geyer | G04G 17/083 | 368/11 |
| 2015/0009783 A1 * | 1/2015 | Hanzawa | G02B 6/0061 | 368/67 |
| 2019/0227217 A1 * | 7/2019 | Lin | G04B 19/30 | |

FOREIGN PATENT DOCUMENTS

CN 108227456 A 6/2018

* cited by examiner

*Primary Examiner* — Edwin A. Leon
*Assistant Examiner* — Jason M Collins
(74) *Attorney, Agent, or Firm* — Schmeiser, Olsen & Watts, LLP

(57) ABSTRACT

A light-emitting clock has a case, a dial, a light-emitting mechanism, a movement and a plurality of hands. The case has a front cover, a back cover and a washer. The front cover is coupled to the back cover. The washer is disposed between the front cover and the back cover. The dial is disposed between the washer and the back cover. The light-emitting mechanism has a switch, a power unit electrically connected to the switch, and at least one lamp strip electrically connected to the switch. The switch and the power unit are disposed on the back cover. The lamp strip is annularly disposed at the washer. A light-emitting surface of the lamp strip at least faces the rim of the dial. The movement is disposed on the back cover. The hands are coupled to the movement and correspond in position to one side of the dial.

12 Claims, 10 Drawing Sheets

LIGHT-EMITTING CLOCK

CROSS-REFERENCE TO RELATED APPLICATION

This non-provisional application claims priority under 35 U.S.C. § 119(a) on Patent Application No(s). 201810840068.9 filed in China on Jul. 27, 2018, the entire contents of which are hereby incorporated by reference.

FIELD OF THE INVENTION

The present disclosure relates to light-emitting clocks and, more particularly, to a light-emitting clock that has a simple overall structure and incurs low processing costs while ensuring uniform illumination.

BACKGROUND OF THE INVENTION

Conventional clocks each typically include hands, a dial, a movement and a case. The hands and the movement are disposed in the case. Each hand and the movement are disposed on two opposing surfaces of the dial, respectively. A through hole is disposed at the center of the dial, allowing the hands to connect to the movement.

To facilitate its nocturnal use, the clock has one or more lights. Despite the lights, the dial cannot be uniformly illuminated, causing parts of the dial to look brighter/darker than the others. As a result, checking time on the clock at night stresses one's eyes. Furthermore, the aforesaid uneven illumination of the dial renders the clock less visually pleasing.

In view of this, China's published patent CN108227456A discloses a clock with satisfactory uniform illumination. Referring to FIG. 1 through FIG. 3, the clock comprises an acrylic plate 91, a uniform illumination paper 92, a screen printing ink layer 93, a circuit board 94 and a plurality of LED lamps 95. The acrylic plate 91 is disk-shaped. An annular blind groove 96 is disposed at the rim of the upper surface of the acrylic plate 91. The annular blind groove 96 has a bottom surface 961, an annular outer wall surface 962 and an annular inner wall surface 963. The circuit board 94 is bendable and slender. The LED lamps 95 are disposed on the circuit board 94 and equidistantly spaced apart. The circuit board 94 adheres to the annular outer wall surface 962 and takes on a ring shape. The LED lamps 95 emit light beams which fall on the annular outer wall surface 962. The screen printing ink layer 93 is a white ink layer formed on the back of the acrylic plate 91 by screen printing. The acrylic plate 91 demonstrates high light penetrability. The annular blind groove 96 is disposed at the rim of the upper surface of the acrylic plate 91. The circuit board 94 is disposed in the annular blind groove 96 and is substantially annular. The LED lamps 95 are disposed on the circuit board 94 and emit light beams toward the inner portion of the acrylic plate 91. The light beams diffuse and reflect off the screen printing ink layer 93. The screen printing ink layer 93 is preferably implemented as a plurality of round ink points. The edges of the round ink points are effective in effectuating diffusion and reflection; hence, the round ink points, coupled with the uniform illumination paper 92 disposed on the acrylic plate 91, turn the light beams into a surface light source.

Although the clock disclosed in China's published patent CN108227456A is effective in achieving uniform illumination, its manufacturing has drawbacks as follows:

First, an annular blind groove is disposed at the edge of the upper surface of the acrylic plate, but forming the annular blind groove adds to production costs, reduces production efficiency, and lowers production yield.

Second, a plurality of LED lamps on the circuit board may look like a bright ring in a user's eyes and thus be less visually pleasing. To lessen this undesirable phenomenon, the clock has a uniform illumination paper. However, the uniform illumination paper not only incurs material costs, but also requires following processing and adhesion steps, thereby reducing production efficiency.

Third, embedding a lamp strip in a groove on the clock places limitations on the appearance design of the clock, because a front frame has to be wide enough to hide a direct light source, and hiding too much clock surface places limitations on the appearance design of the clock.

Therefore, it is important to provide a light-emitting clock with advantages as follows: simplifying the processing process of the light-emitting clock; enhancing the production efficiency of the light-emitting clock, enhancing the production yield of the light-emitting clock, and reducing structure-induced limitations otherwise placed on appearance design of the light-emitting clock.

SUMMARY OF THE INVENTION

In view of the aforesaid drawbacks of the prior art, it is an objective of the present disclosure to provide a light-emitting clock with advantages as follows: simplifying the processing process of the light-emitting clock; enhancing the production efficiency of the light-emitting clock, enhancing the production yield of the light-emitting clock, and reducing structure-induced limitations otherwise placed on appearance design of the light-emitting clock.

In order to achieve the above and other objectives, the present disclosure provides a light-emitting clock comprising a case, a dial, a light-emitting mechanism, a movement and a plurality of hands. The case has a front cover, a back cover and a washer. The front cover is coupled to the back cover. The washer is disposed between the front cover and the back cover. The dial is disposed between the washer and the back cover. The light-emitting mechanism comprises a switch, a power unit electrically connected to the switch, and at least one lamp strip electrically connected to the switch. The switch and the power unit are disposed on the back cover. The lamp strip is annularly disposed at the washer. The light-emitting surface of the lamp strip at least faces the rim of the dial. The movement is disposed on the back cover. The hands are coupled to the movement and correspond in position to one side of the dial.

Regarding the light-emitting clock, a receiving groove is annularly disposed at an inner edge of a bottom of the washer, and the lamp strip is disposed in the receiving groove.

Regarding the light-emitting clock, another receiving groove is annularly disposed at an outer edge of a top of the washer and has another lamp strip electrically connected to the switch.

Regarding the light-emitting clock, the dial is made of a light-penetrable material, a surface of the dial has a plurality of light guide mesh points and a digital region, and a back of the dial has a uniform illumination layer.

Regarding the light-emitting clock, the dial is made of a light-penetrable acrylic material or polystyrene (PS).

Regarding the light-emitting clock, the light-emitting mechanism further comprises a light sensor and a timer which are each electrically connected to the switch, the light sensor being disposed at the dial, and the timer being disposed at the back cover.

Regarding the light-emitting clock, the lamp strip has a plurality of LED lamps spaced apart.

The light-emitting clock further comprises an acrylic plate and a screen printing ink layer, the screen printing ink layer being a white ink layer formed on a back of the acrylic plate by screen printing, with the acrylic plate abutting against the back cover and the dial disposed on a side of the acrylic plate, such that a relief space is defined by and between the washer, the acrylic plate and the back cover, with the lamp strip disposed in the relief space, allowing the light-emitting surface of the lamp strip to face a rim of the acrylic plate.

Regarding the light-emitting clock, the white ink layer has a plurality of round ink points independent of each other and arranged in a matrix.

Regarding the light-emitting clock, the back cover has a movement holding chamber, a central abutting surface and a peripheral abutting surface such that the central abutting surface and the peripheral abutting surface abut against and lend support to the acrylic plate from a central and a periphery, respectively.

Regarding the light-emitting clock, the washer is substantially annular and has an end abutting head for abutting against and contacting the back cover and a lower abutting surface for abutting against the acrylic plate, with the relief space disposed between the lower abutting surface and the end abutting head.

Regarding the light-emitting clock, the lamp strip has a positive line, a negative line and a plurality of shunt circuits, the shunt circuits correlating with each other and each having an LED lamp and a resistor in series connection to the LED lamp.

Therefore, a light-emitting clock of the present disclosure dispenses with an annular blind groove and a uniform illumination paper and thus simplifies the processing process of the light-emitting clock greatly, enhances the production efficiency of the light-emitting clock, improves the production yield of the light-emitting clock, and reduces structure-induced limitations otherwise placed on appearance design of the light-emitting clock.

DETAILED DESCRIPTION OF THE PREFERRED EMBODIMENTS

Objectives, features, and advantages of the present disclosure are hereunder illustrated with specific embodiments, depicted with drawings, and described below.

Figure 1:
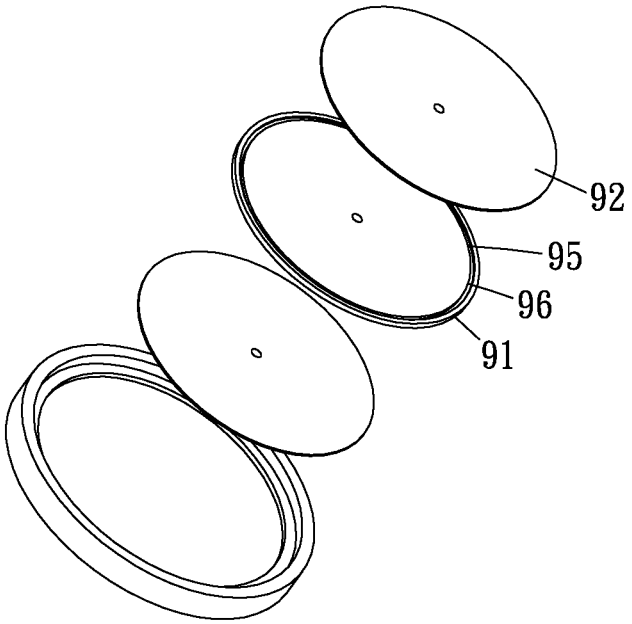
(PRIOR ART) FIG. 1
FIG. 1 (PRIOR ART) is an exploded view of a conventional clock capable of satisfactory uniform illumination.
Figure 2:
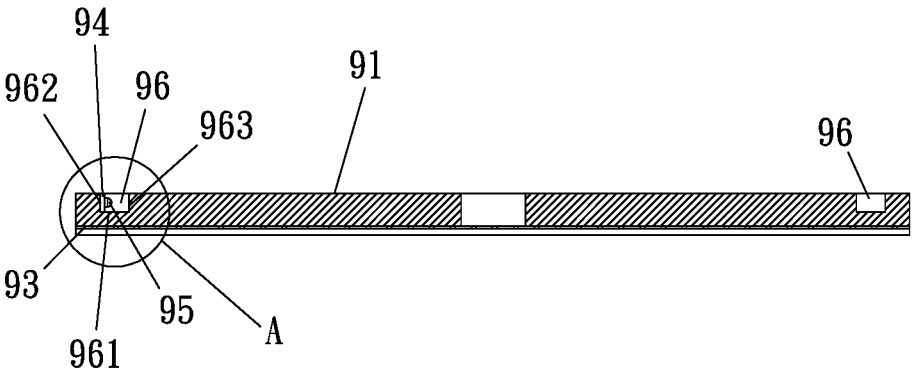
(PRIOR ART) FIG. 2
FIG. 2 (PRIOR ART) is a schematic view of the conventional clock, showing a circuit board disposed in an annular blind groove.
Figure 3:
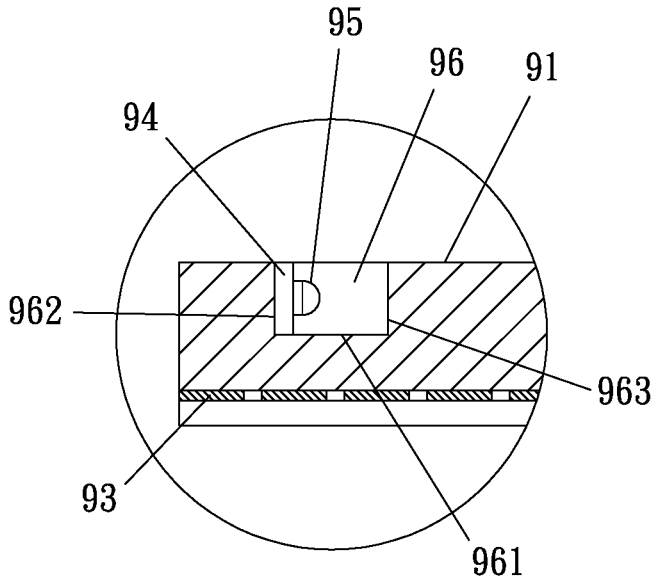
(PRIOR ART) FIG. 3
FIG. 3 (PRIOR ART) is an enlarged view of part A in FIG. 2.
Figure 4:
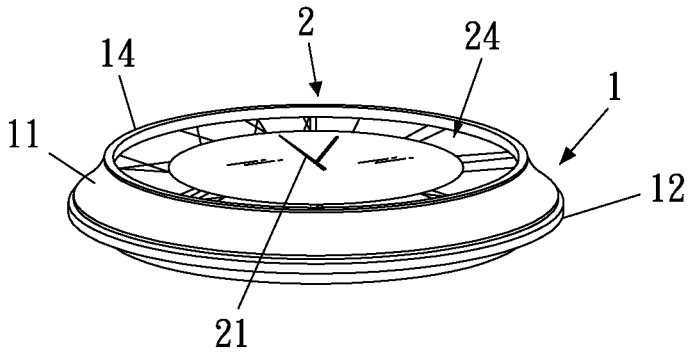
FIG. 4 is a perspective view of a light-emitting clock according to the first preferred embodiment of the present disclosure.
Figure 5:
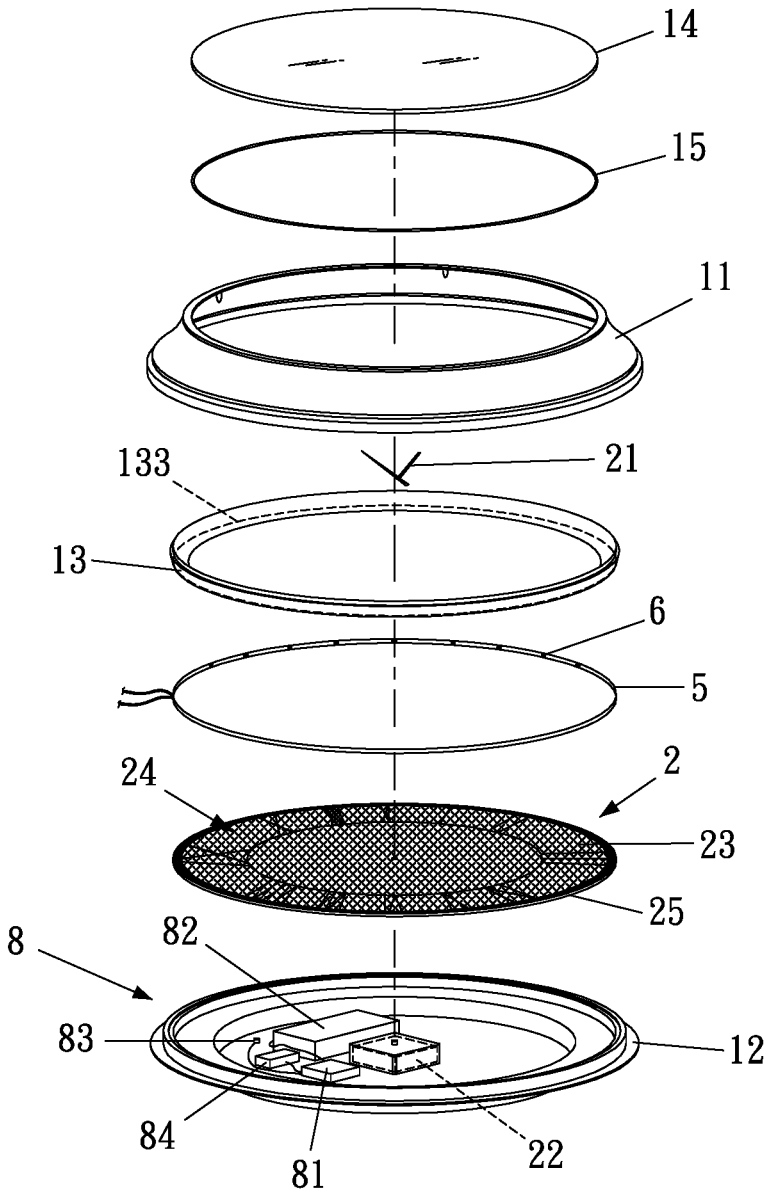
FIG. 5 is an exploded view of the light-emitting clock according to the first preferred embodiment of the present disclosure.
Figure 6:
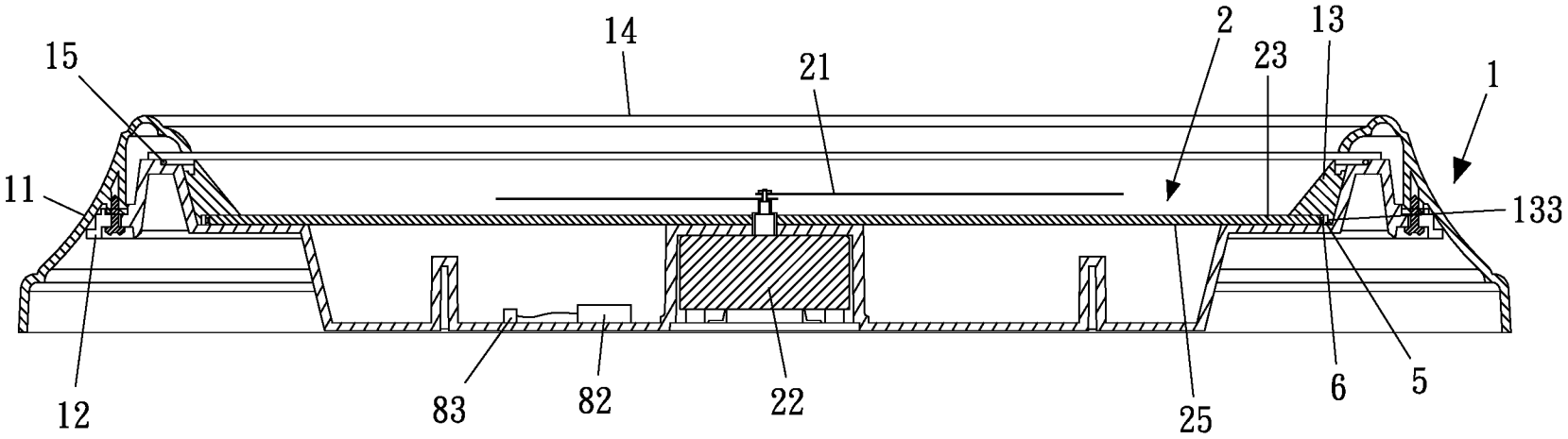
FIG. 6 is a cross-sectional view of the light-emitting clock according to the first preferred embodiment of the present disclosure.
Figure 7:
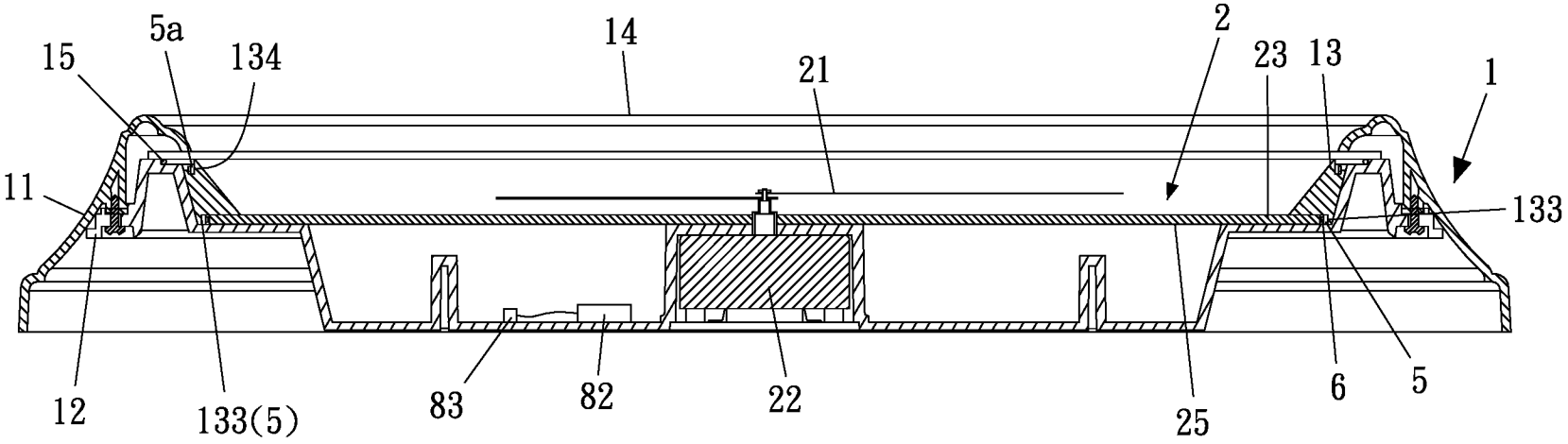
FIG. 7 is a cross-sectional view of the light-emitting clock according to the second preferred embodiment of the present disclosure.
Figure 8:
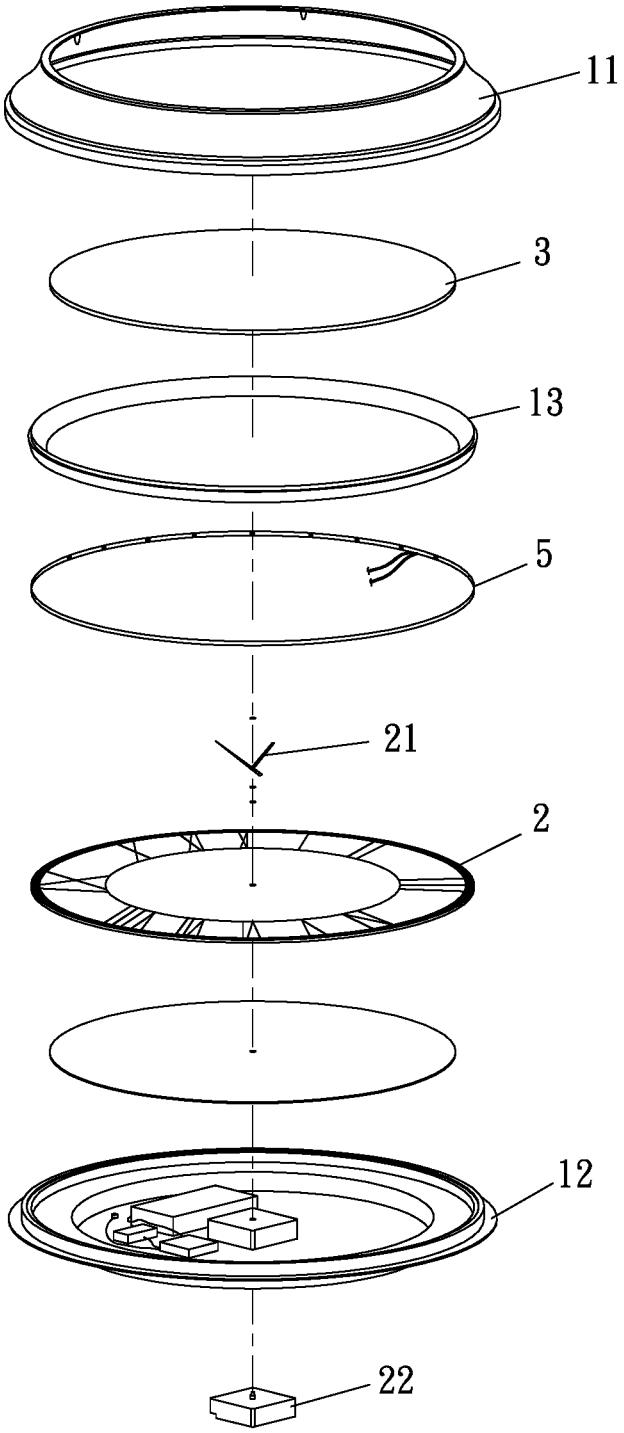
FIG. 8 is an exploded view of the light-emitting clock according to the third preferred embodiment of the present disclosure.
Figure 9:
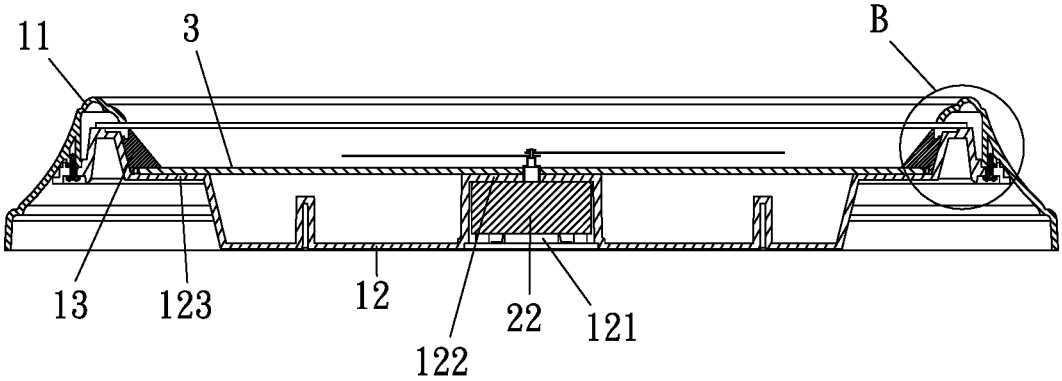
FIG. 9 is a schematic view of the internal structure of the light-emitting clock according to the third preferred embodiment of the present disclosure.
Figure 10:
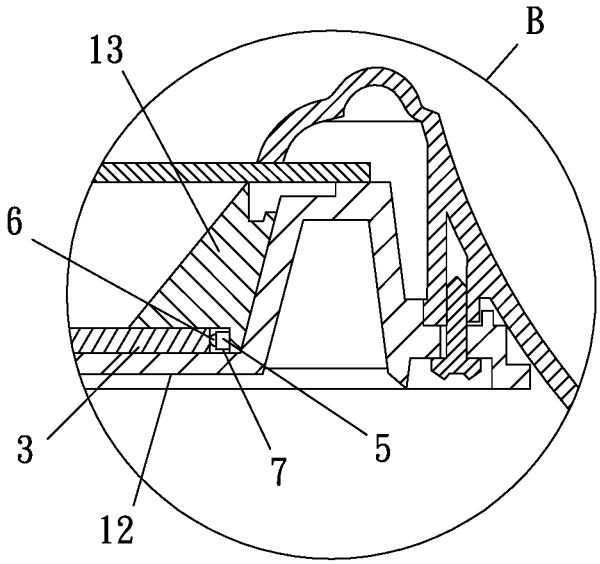
FIG. 10 is an enlarged view of part B in FIG. 9.
Figure 11:
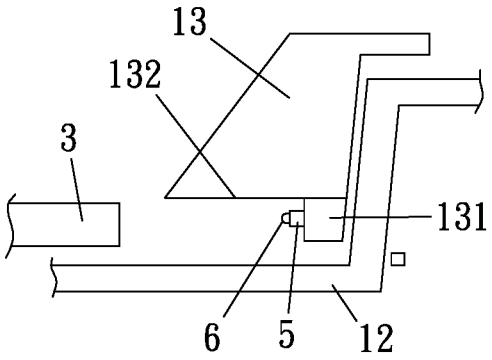
FIG. 11 is a schematic view of a relief space of the light-emitting clock according to the third preferred embodiment of the present disclosure.
Figure 12:
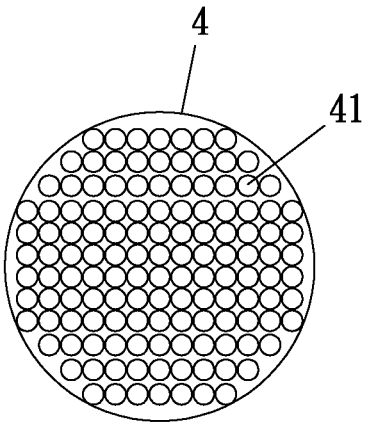
FIG. 12 is a schematic view of a screen printing ink layer of the light-emitting clock according to the third preferred embodiment of the present disclosure.
Figure 13:
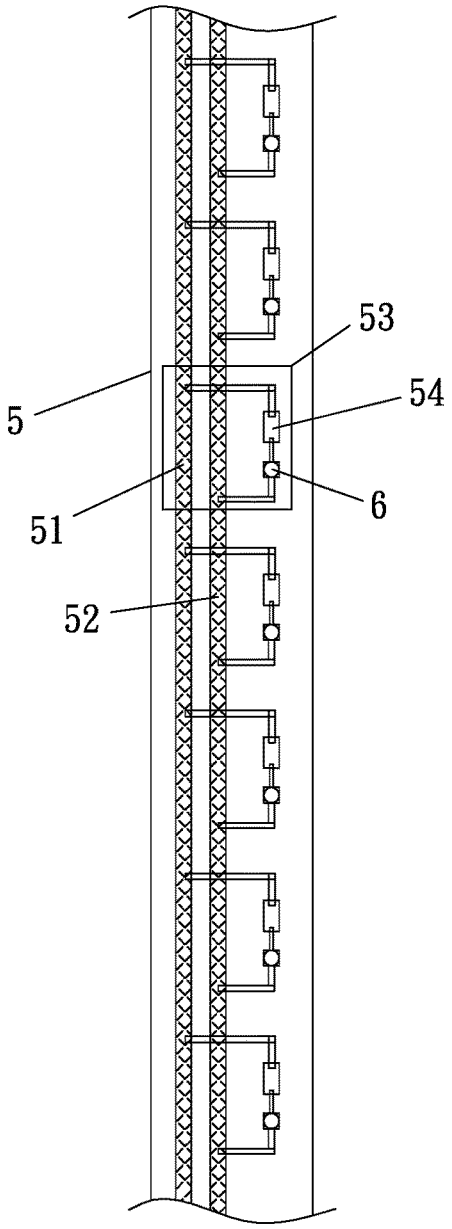
FIG. 13 is a schematic view of circuitry of a lamp strip of the light-emitting clock according to the third preferred embodiment of the present disclosure.
Figure 14:
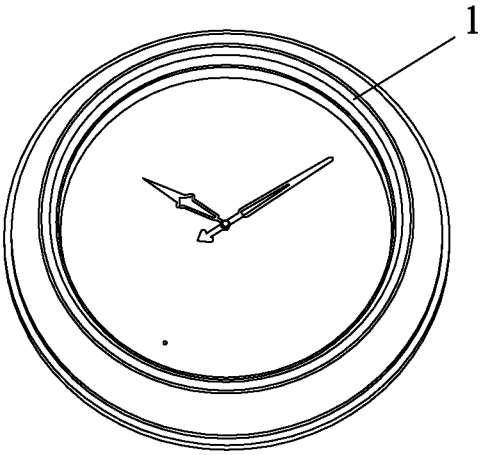
FIG. 14 is a front schematic view of the light-emitting clock according to the third preferred embodiment of the present disclosure.
Figure 15:
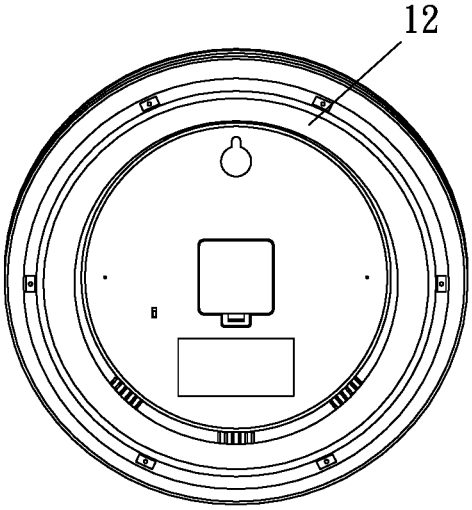
FIG. 15 is a schematic view of a back cover of the light-emitting clock according to the third preferred embodiment of the present disclosure.

Referring to FIG. 4 and FIG. 5, the present disclosure provides a light-emitting clock comprising a case 1, a dial 2, a light-emitting mechanism 8, a movement 22 and a plurality of hands 21.

The case 1 has a front cover 11, a back cover 12 and a washer 13. The front cover 11 is coupled to the back cover 12. The washer 13 is disposed between the front cover 11 and the back cover 12. The front cover 11 further comprises a transparent protective lid 14 and an O-ring 15. The transparent protective lid 14 and the O-ring 15 protect the dial 2, the hands 21 and the light-emitting mechanism 8.

The dial 2 is disposed between the washer 13 and the back cover 12.

The light-emitting mechanism 8 comprises a switch 81, a power unit 82 electrically connected to the switch 81, and at least one lamp strip 5 electrically connected to the switch 81. The switch 81 and the power unit 82 are disposed on the back cover 12. The lamp strip 5 is annularly disposed at the bottom of the washer 13. The light-emitting surface of the lamp strip 5 at least faces the rim of the dial 2. The power unit 82 is a primary battery or secondary battery. The lamp strip 5 has a plurality of LED lamps 6. The LED lamps 6 are spaced apart. The light-emitting surface of the LED lamps 6 at least faces the rim of the dial 2.

The movement 22 is disposed on the back cover 12.

The plurality of hands 21 is coupled to the movement 22 and corresponds in position to one side of the dial 2. The movement 22 drives the hands 21 and indicates time in conjunction with the dial 2.

The lamp strip 5 is disposed at the bottom of the washer 13. When viewed from the front, the lamp strip 5 is behind the washer 13, and thus the LED lamps 6 of the lamp strip 5 are hidden behind the washer 13. Hence, cores of the LED lamps 6 and concentrated bright areas in front of the LED lamps 6 are invisible. For this reason, it is unnecessary to form an annular blind groove on the dial 2 or at any other location, nor is the uniform illumination paper required. Therefore, the processing process of the light-emitting clock is greatly simplified, and the production efficiency of the light-emitting clock is enhanced.

To start using the light-emitting clock, the user starts the switch 81 to allow the power unit 82 to output power to the lamp strip 5 and thus allow the LED lamps 6 on the lamp strip 5 to emit light. When the LED lamps 6 emits light, its light-emitting surface emits light beams from the rim of the dial 2 such that the light beams travel toward the center of the dial 2 and illuminate the dial 2 uniformly. Therefore, at night, the user can check time on the uniformly-illuminated dial 2 easily.

In a preferred embodiment of the present disclosure, a receiving groove 133 is annularly disposed at the inner edge of the bottom of the washer 13. The lamp strip 5 is disposed in the receiving groove 133. Therefore, the lamp strip 5 can be easily mounted in place, not to mention that it is unnecessary to place an annular blind groove at the dial 2 or any other location. Therefore, the light-emitting clock of the present disclosure has the following advantages: simplifying greatly the processing process of the light-emitting clock, enhancing the production efficiency of the light-emitting clock, enhancing the production yield of the light-emitting clock, reducing structure-induced limitations otherwise placed on appearance design of the light-emitting clock, and augmenting the flexibility and openness of product design, allowing more appearance design to be applied to the light-emitting clock of the present disclosure.

In a preferred embodiment of the present disclosure, the dial 2 is made of a light-penetrable material, such as acrylic material or polystyrene (PS). The surface of the dial 2 has a plurality of light guide mesh points 23 and a digital region 24. The back of the dial 2 has a uniform illumination layer 25. The uniform illumination layer 25 is a white ink layer formed on the back of the acrylic plate by screen printing. The digital region 24 indicates time whenever the movement 22 drives the hands 21.

When the LED lamps 6 of the lamp strip 5 emit light which is going to fall on the rim of the dial 2, the light diffuses and reflects off the light guide mesh points 23 and the uniform illumination layer 25 such that the dial 2 is uniformly illuminated to attain optimal illumination.

In a preferred embodiment of the present disclosure, the light-emitting mechanism 8 further comprises a light sensor 83 and a timer 84. The light sensor 83 and the timer 84 are each electrically connected to the switch 81. The light sensor 83 is disposed at the dial 2. The timer 84 is disposed at the back cover 12. To start using the light-emitting clock, the user starts the switch 81, the light sensor 83 and the timer 84 such that the light sensor 83 begins detecting ambient brightness. Upon detection that the ambient brightness is insufficient, the light sensor 83 drives the LED lamps 6 of the lamp strip 5 to emit light. Alternatively, the LED lamps 6 of the lamp strip 5 emit light within a specific time period determined with the timer 84, as needed. In practice, it is feasible to dispense with one of the light sensor 83 and the timer 84 as needed.

Referring to FIG. 4, in the second preferred embodiment of the present disclosure, another receiving groove 134 is annularly disposed at the outer edge of the top of the washer 13 and has another lamp strip 5*a*. The other lamp strip 5*a* is electrically connected to the switch 81. Both the other lamp strip 5*a* and the lamp strip 5 are of identical structures. Not only is the lamp strip 5 disposed at the inner edge of the bottom of the washer 13 enables the dial 2 to be uniformly illuminated, but the other lamp strip 5*a* disposed at the top of the washer 13 also, whether simultaneously or separately, emits light, thereby illuminating the case 1 (at the very least the surface of the front cover 11) of the light-emitting clock. Therefore, the light-emitting clock of the present disclosure is visually pleasing.

Referring to FIG. 5 through FIG. 15, the light-emitting clock in the third preferred embodiment of the present disclosure comprises a case 1, a dial 2, a plurality of hands 21 and a movement 22. The movement 22 is connected to the hands 21 and drives the hands 21 to indicate the current time in conjunction with the dial 2. The case 1 has a front cover 11, a back cover 12, and a washer 13 disposed between the front cover 11 and the back cover 12. The front cover 11 and the back cover 12 are connected by screws. The washer 13 is made of a plastic material and thus is capable of plastic deformation. Therefore, the washer 13 is abuttingly connected between the front cover 11 and the back cover 12 effectively to enable the front cover 11, the back cover 12 and the washer 13 to be fixed to each other and thus ensure the overall stability of the light-emitting clock.

The light-emitting clock of the present disclosure further comprises an acrylic plate 3, a screen printing ink layer 4 and a lamp strip 5. The lamp strip 5 is annularly arranged and has a plurality of LED lamps 6 spaced apart. The screen printing ink layer 4 is a white ink layer formed on the back of the acrylic plate 3 by screen printing. Light emitted from the plurality of LED lamps 6 on the lamp strip 5 reflects off the white ink layer and diffuses so as to achieve uniform illumination.

The washer 13 presses the acrylic plate 3 against the back cover 12 such that the light-emitting clock is subjected to different forces but is in equilibrium to therefore attain stable connection between its components. The washer 13, the acrylic plate 3 and the back cover 12 together define a relief space 7 therebetween. The lamp strip 5 is disposed in the relief space 7, and the light-emitting surface of the LED lamps 6 faces the rim of the acrylic plate 3. Hence, the structural fine-tuning of the washer 13, the acrylic plate 3 and the back cover 12 relative to each other enables construction of the relief space 7 for accommodating the lamp strip 5. Afterward, the lamp strip 5 is fixed in place to ensure that light emitted from the lamp strip 5 falls fully on the acrylic plate 3 in the same way as the prior art discloses. Then, reflection and diffusion achieved by the white ink layer enables uniform illumination as well.

With the lamp strip 5 being disposed in the relief space 7 and the relief space 7 being behind the washer 13 when viewed from the front, the LED lamps 6 of the lamp strip 5 are hidden behind the washer 13, the user cannot see the cores of the LED lamps 6 and the concentrated bright areas in front of the LED lamps 6. For this reason, the uniform illumination paper is not required, thereby saving material costs and installation costs of the uniform illumination paper, simplifying installation steps, and enhancing installation efficiency greatly. The present disclosure makes good use of the washer 13 required for many conventional clocks, and thus actual installation only entails aligning the lamp strip 5, fixing the lamp strip 5 to the washer 13, and then mounting the lamp strip 5 on the acrylic plate 3 on a one-time basis. The present disclosure is also advantageous in that light emitted from the LED lamps 6 disposed on the lamp strip 5 falls on the acrylic plate 3 and then reflects off the white ink layer formed on the back of the acrylic plate 3 before diffusing, so as to achieve uniform illumination. In addition, coupling together the washer 13 and the lamp strip 5 can simplify the operation process greatly, reduce production costs, and enhance competitiveness.

In a preferred embodiment of the present disclosure, to optimize the reflection and diffusion of the light emitted from the LED lamps 6 and reflected off the white ink layer, the white ink layer has a plurality of round ink points 41 independent of each other. The round ink points 41 are arranged in a matrix. Light emitted from the LED lamps 6 reflects off the round ink points 41 and diffuses such that the light emitted from the LED lamps 6 illuminates the dial 2 uniformly. On the other hand, the round ink points 41 are arranged in a matrix such that the light emitted from the LED lamps 6 reflects off the round ink points 41 and diffuses before falling on the dial 2 uniformly.

In a preferred embodiment of the present disclosure, to ensure that the acrylic plate 3 and the dial 2 are parallel and further ensure that the stability of the light-emitting clock of the present disclosure. The dial 2 is disposed on the back of the acrylic plate 3. The back cover 12 has a movement holding chamber 121, a central abutting surface 122 and a peripheral abutting surface 123. The central abutting surface 122 and the peripheral abutting surface 123 abut against and lend support to the acrylic plate 3 from the central and the periphery, respectively, to enhance the stability of the light-emitting clock in its entirety and ensure the uniform illumination following the reflection of the light off the screen printing ink layer 4 and the diffusion of the light.

In a preferred embodiment of the present disclosure, to enable the relief space 7 to be formed, the washer 13 is substantially annular and has an end abutting head 131 for abutting against and contacting the back cover 12, and a lower abutting surface 132 for abutting against the acrylic plate 3. The relief space 7 is disposed between the lower abutting surface 132 and the end abutting head 131 and defined by and between the lower abutting surface 132, the end abutting head 131, the sidewall of the acrylic plate 3, and the back cover 12. Given the uniform illumination, the relief space 7 further saves the materials which the uniform illumination paper is made of, simplifies the installation process, enhances the installation efficiency, and reduces the product costs.

In a preferred embodiment of the present disclosure, the lamp strip 5 has a positive line 51, a negative line 52 and a plurality of shunt circuits 53. The shunt circuits 53 correlate with each other and thus are equal in voltage. The shunt circuits 53 each have an LED lamp 6 and a resistor 54 in series connection with the LED lamps 6; hence, the LED lamps 6 on each shunt circuit 53 are equal in brightness. This precludes a voltage difference which might otherwise lead to a difference in the brightness of the LED lamps 6. Therefore, the present disclosure prevents unequal brightness of the dial 2 illuminated with the LED lamps 6; hence, the light-emitting clock of the present disclosure achieves uniform illumination and allows the LED lamps 6 to consume less electric power.

The present disclosure is disclosed above by preferred embodiments. However, persons skilled in the art should understand that the preferred embodiments are illustrative of the present disclosure only, but shall not be interpreted as restrictive of the scope of the present disclosure. Hence, all equivalent modifications and replacements made to the aforesaid embodiments shall fall within the scope of the present disclosure. Accordingly, the legal protection for the present disclosure shall be defined by the appended claims.

What is claimed is:

1. A light-emitting clock, comprising:

a case having a front cover, a back cover and a washer, the front cover being coupled to the back cover, with the washer disposed between the front cover and the back cover;

a dial disposed between the washer and the back cover;

a light-emitting mechanism comprising a switch, a power unit electrically connected to the switch, and at least one lamp strip electrically connected to the switch, wherein the switch and the power unit are disposed on the back cover, with the lamp strip annularly disposed at the washer, and a light-emitting surface of the lamp strip at least faces a rim of the dial;

a movement disposed on the back cover; and a plurality of hands coupled to the movement and corresponding in position to a side of the dial.

2. The light-emitting clock of claim 1, wherein a receiving groove is annularly disposed at an inner edge of a bottom of the washer, and the lamp strip is disposed in the receiving groove.

3. The light-emitting clock of claim 1, wherein another receiving groove is annularly disposed at an outer edge of a top of the washer and has another lamp strip electrically connected to the switch.

4. The light-emitting clock of claim 1, wherein the dial is made of a light-penetrable material, a surface of the dial has a plurality of light guide mesh points and a digital region, and a back of the dial has a uniform illumination layer.

5. The light-emitting clock of claim 4, wherein the dial is made of a light-penetrable acrylic material or polystyrene (PS).

6. The light-emitting clock of claim 1, wherein the light-emitting mechanism further comprises a light sensor and a timer which are each electrically connected to the switch, the light sensor being disposed at the dial, and the timer being disposed at the back cover.

7. The light-emitting clock of claim 1, wherein the lamp strip has a plurality of LED lamps spaced apart.

8. The light-emitting clock of claim 1, further comprising an acrylic plate and a screen printing ink layer, the screen printing ink layer being a white ink layer formed on a back of the acrylic plate by screen printing, with the acrylic plate abutting against the back cover and the dial disposed on a side of the acrylic plate, such that a relief space is defined by and between the washer, the acrylic plate and the back cover, with the lamp strip disposed in the relief space, allowing the light-emitting surface of the lamp strip to face a rim of the acrylic plate.

9. The light-emitting clock of claim 8, wherein the white ink layer has a plurality of round ink points independent of each other and arranged in a matrix.

10. The light-emitting clock of claim 8, wherein the back cover has a movement holding chamber, a central abutting surface and a peripheral abutting surface such that the central abutting surface and the peripheral abutting surface abut against and lend support to the acrylic plate from a central and a periphery, respectively.

11. The light-emitting clock of claim 8, wherein the washer is substantially annular and has an end abutting head for abutting against and contacting the back cover and a lower abutting surface for abutting against the acrylic plate, with the relief space disposed between the lower abutting surface and the end abutting head.

12. The light-emitting clock of claim 8, wherein the lamp strip has a positive line, a negative line and a plurality of shunt circuits, the shunt circuits correlating with each other and each having an LED lamp and a resistor in series connection with the LED lamp.

* * * * *